US006662393B2

(12) United States Patent
Boyd

(10) Patent No.: US 6,662,393 B2
(45) Date of Patent: Dec. 16, 2003

(54) COMPOSITE MATTRESS

(76) Inventor: Dennis Boyd, 14457 Rouge River, Chesterfield, MO (US) 63017

( * ) Notice: Subject to any disclaimer, the term of this patent is extended or adjusted under 35 U.S.C. 154(b) by 0 days.

(21) Appl. No.: 10/102,041

(22) Filed: Mar. 19, 2002

(65) Prior Publication Data

US 2003/0177584 A1 Sep. 25, 2003

(51) Int. Cl.[7] ..... A47C 27/15
(52) U.S. Cl. ..... 5/727; 5/739; 5/740
(58) Field of Search ..... 5/727, 728, 739, 5/740

(56) References Cited

U.S. PATENT DOCUMENTS

| | | | | |
|---|---|---|---|---|
| 82,975 A | | 10/1868 | Morey | |
| 2,831,532 A | | 4/1958 | Kasper | 155/182 |
| 3,222,697 A | | 12/1965 | Scheermesser | 5/361 |
| 3,846,857 A | | 11/1974 | Weinstock | 5/345 R |
| 3,939,508 A | | 2/1976 | Hall et al. | 5/345 R |
| 4,086,675 A | | 5/1978 | Talbert et al. | 5/355 |
| 4,288,903 A | | 9/1981 | Matsuda et al. | 29/416 |
| 4,316,298 A | | 2/1982 | Russo et al. | 5/465 |
| 4,520,517 A | | 6/1985 | Ahlm | 5/481 |
| 4,980,940 A | | 1/1991 | Isshiki | 5/468 |
| 5,107,558 A | | 4/1992 | Lück | 5/464 |
| 5,231,717 A | * | 8/1993 | Scott et al. | 5/727 |
| 5,513,402 A | | 5/1996 | Schwartz | 5/96 |
| 5,636,395 A | | 6/1997 | Serda | 5/691 |
| 5,669,094 A | | 9/1997 | Swanson | 5/740 |
| 5,671,492 A | | 9/1997 | Simon | 5/722 |
| 5,701,623 A | | 12/1997 | May | 5/739 |
| 5,745,940 A | | 5/1998 | Roberts et al. | 5/727 |
| 5,836,027 A | | 11/1998 | Leventhal et al. | 5/706 |
| 5,850,648 A | * | 12/1998 | Morson | 5/724 |
| 5,960,496 A | | 10/1999 | Boyd | 5/722 |
| 6,085,373 A | * | 7/2000 | Montana | 5/727 |
| 6,159,574 A | | 12/2000 | Landvik et al. | 428/71 |
| 6,212,720 B1 | | 4/2001 | Antinori et al. | 5/727 |
| 6,223,371 B1 | | 5/2001 | Antinori et al. | 5/727 |
| 6,256,821 B1 | | 7/2001 | Boyd | 5/722 |
| 6,286,167 B1 | | 9/2001 | Stolpmann | 5/737 |
| 6,295,674 B1 | | 10/2001 | Smith-McKelvey et al. | 5/690 |
| 6,311,351 B1 | | 11/2001 | Murphy | 5/727 |
| 6,481,033 B2 | * | 11/2002 | Fogel | 5/727 |

FOREIGN PATENT DOCUMENTS

GB 1593433 A * 7/1981

* cited by examiner

*Primary Examiner*—Michael F. Trettel
(74) *Attorney, Agent, or Firm*—Thompson Coburn LLP

(57) ABSTRACT

A composite mattress made of both high resilience foam and low resilience foam. The base is made of the low resilience foam. The sleep surface is made of the high resilience foam. Edge supports are provided to prevent bottoming out. The sleep surface covers the base and the edge supports.

8 Claims, 4 Drawing Sheets

COMPOSITE MATTRESS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention relates generally to devices intended to receive the human body in a prone, supine, or sitting position and, more particularly, a composite mattress having an improved sleep surface and edge support.

Current conventional mattresses are known which are composed primarily of foam material. These foam mattresses are useful, but they could be improved. The foam material used for mattresses comes in high resilience and low resilience types. Unfortunately, high resilience foams, such as latex or viscoelastic foams, are relatively expensive as compared to less resilient foams such as polyurethane foams.

Consumers and retailers desire a high profile mattress which can be anywhere from twelve to twenty five inches in height. Current manufacturing technology for the high resilience latex foam can produce a sheet up to six inches in thickness. Mattresses made entirely from the more desirable high resilience foams can easily become too expensive for general use. The low resilience foams can be manufactured in thicknesses of four feet or more. A conventional foam mattresses made entirely from low resilience foam must be rotated and flipped frequently (every few months). Composite mattress have been developed which use both types of foams.

2. Related Art

U.S. Pat. No. 82,975 to Morey discloses what appears to be one of the first patents covering a mattress. The invention saw an excelsior such as moss, hay or straw sandwiched between layers of sponge. Fortunately, technology in this area has continued to develop.

U.S. Pat. No. 2,831,532 to Kasper discloses laminating layers of fiberglass, foam rubber, cotton matting or sponge rubber to create cushions or mattresses. This is one of the first uses of layering for support and comfort. U.S. Pat. Nos.: 6,223,371; 6,295,674; 6,159,574; 5,745,940; and 3,939,508 all teach using different types of foam in varying configurations.

Customers complained that some early foam mattresses "bottom out". This occurs while the occupant sits on the edge of the bed. The mattress can support the weight of the occupant when lying on the bed, but the concentration of the weight in one spot as when sitting causes the bed to dip or buckle in that spot. U.S. Pat. No. 5,701,623 to May shows a composite mattress which uses firmer border sections to provide additional support when a person sits on the edge of the mattress. My own U.S. Pat. Nos.: 6,256,821 and 5,960,496 (herein incorporated by reference) disclose a mattress system with a firm core 21. Although not stated specifically in the patents the core 21 provides support on the side to prevent bottoming out.

One of the problems created by the use of a firmer material on the side of the mattress is the transition from the sleep surface to the edge of the bed is noticeable and affects the quality of sleep. There does not currently exist a mattress which provides the benefits of the foam sleep surface and the support of the firmer border sections that has a consistent sleep surface.

Accordingly, there is a need for a high profile, low maintenance mattress which can be made economically by combining both high resilience foam and low resilience foam. The low resilience foam can be used in the base to provide support, and the high resilience foam can be used to provide a comfortable sleep surface. The challenge is to provide a mattress with edge support sufficient to avoid "bottoming out" and a smooth transition to the sleep surface.

SUMMARY OF THE INVENTION

It is in view of the above problems that the present invention was developed. The invention is a composite foam mattress having a base made of a firm foam and a sleep surface of a softer and more dense foam. In the first embodiment the base is configured with a channel and the sleep surface rests in the channel. The channel is created by a pair of edge supports. In the second embodiment the edge supports are located on all four sides of the mattress creating a well. These edge supports prevent the mattress from buckling when a person sits on the edge of the mattress. In the third embodiment, the mattress has a base surrounded by edge supports such that the base and the edge supports are the same thickness. The sleep surface covers both the base and the edge supports. The sleep surface is made of a higher density foam and is shaped such that the edge supports are covered at a predetermined thickness. With as little as two inches of foam material a smooth, unnoticeable transition is created. A consumer will feel support when sitting on the edge of the mattress, yet not feel the harder base material when prone and the body weight is dispersed.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
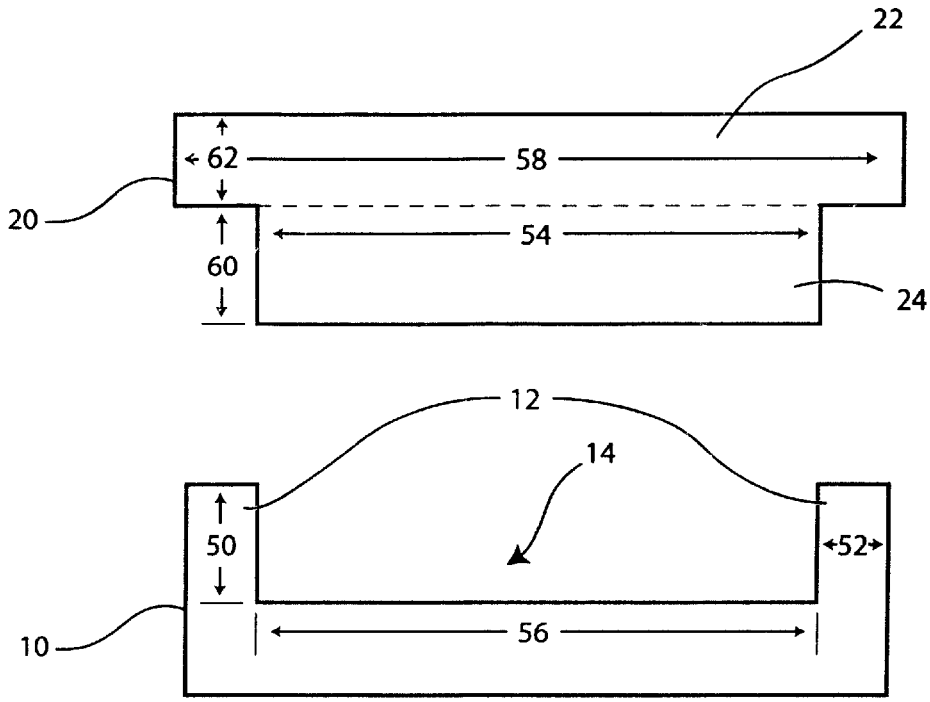
FIG. 1 illustrates a cross sectional view of the mattress.

Referring to the accompanying drawings in which like reference numbers indicate like elements, FIG. 1 illustrates a cross sectional view of the nested foam mattress 1. Base 10 can be made of any suitable material but in the preferred embodiment is made of a polyurethane foam. Sleep surface 20 can be made of any suitable material but in the preferred embodiment is made of a latex foam.

Relative terms such as soft and firm known to consumers have been quantified in the bedding industry in terms of Indention Load Deflection (ILD). The ILD is a measurement which is calculated by measuring the load required to indent a sample a specified percentage of its height. When comparing two materials, the higher ILD value is associated with the firmer material. Research and testing have revealed that low ILD, high density foams make for a comfortable sleep surface. Edge supports 12 have a higher ILD value than the ILD value of the sleep surface 20. In the preferred embodiment the edge support 12 has an ILD of 50 and the sleep surface 20 has an ILD of 18 and the base has an ILD of 30.

Figure 3:
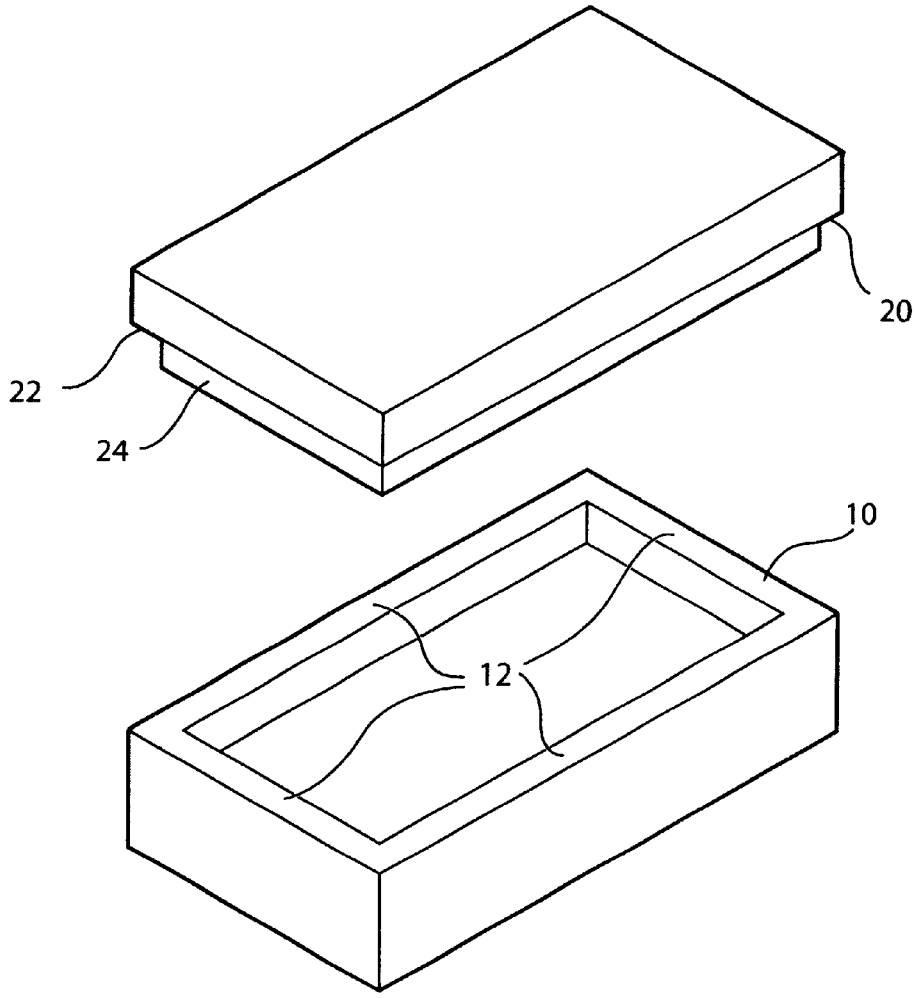
FIG. 3 illustrates an exploded view of the mattress in the second embodiment.

In the first embodiment base 10 has a pair of edge supports 12 extending up from the base and forming a channel 14 between the edge supports 12. In the second embodiment (FIG. 3) the edge supports 12 extend around the periphery of the mattress 1 to all four sides creating a well. The edge supports 12 have an edge support height 50 and can extend up from the base to any suitable height but preferably between two and four inches. The edge supports 12 have an edge support width 52 and can be made any suitable width but preferably four to six inches wide.

Figure 4:
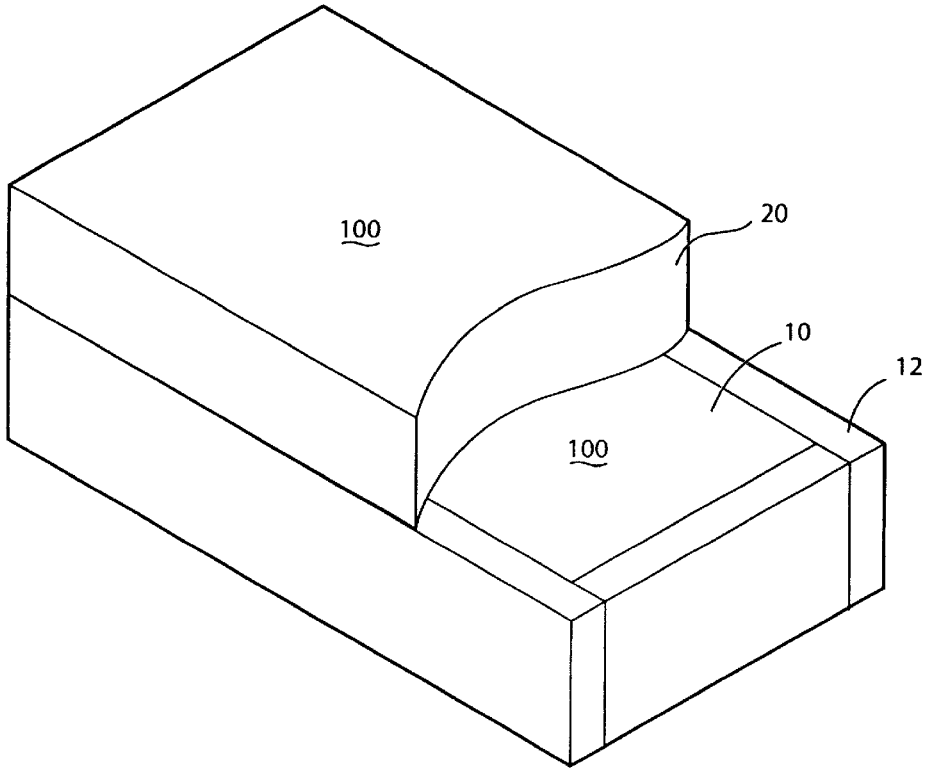
FIG. 4 illustrates a cutaway view of the mattress in the third embodiment.
Figure 5:
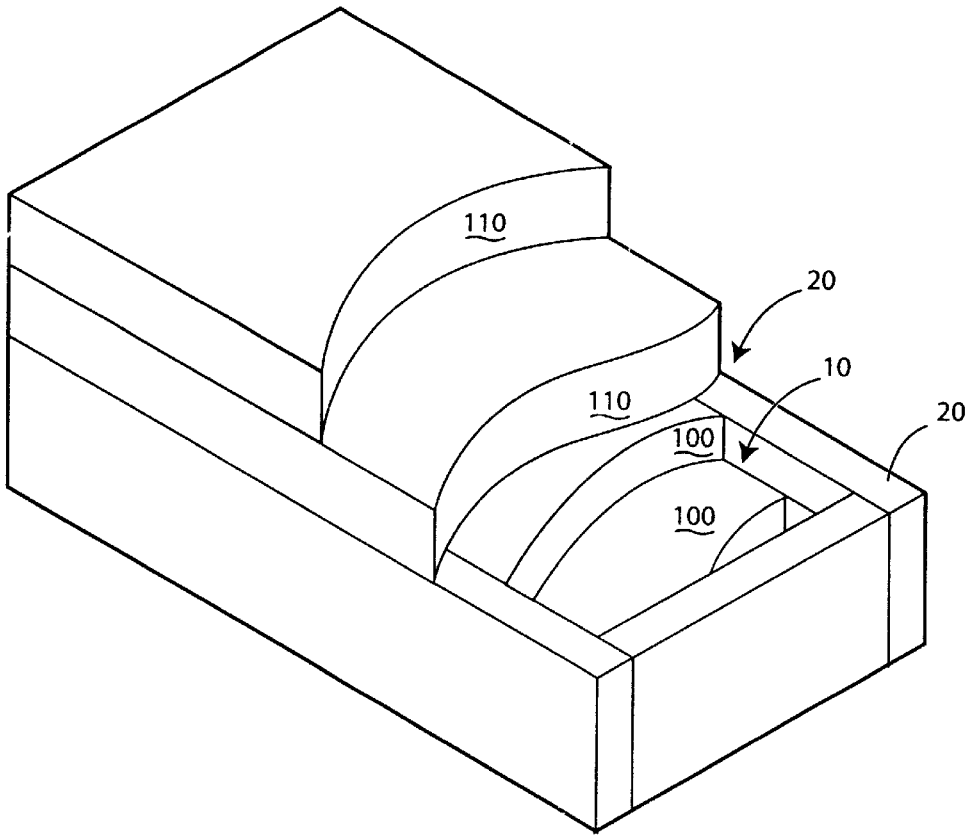
FIG. 5 illustrates a cutaway view of the mattress in an alternative embodiment.

In the first and second embodiments the sleep surface 20 is divided into two regions: upper portion 22 and lower portion 24. The lower portion 24 has a lower portion width 54 equal to a distance 56 between the edge supports 12. The upper portion 22 has an upper portion width 58 equal to the lower portion width 54 plus twice the edge support width 52. The lower portion 24 has a lower portion height 60 equal to the edge support height 50. In the second embodiment the lower portion 24 has a depth equal to the distance between the edge supports. In other words the dimensions of the lower portion 24 are equal to the space bounded by the edge supports. The upper portion has an upper portion height 62 of any suitable distance but in the preferred embodiment is at least two inches. In the preferred embodiment (FIG. 4), the base and the edge supports are the same thickness and the sleep surface covers both the edge supports and the base. The base is made of at least one support layer 100 and the sleep surface is made of at least one comfort layer 110. An alternative configuration of the preferred embodiment is for the base to be made of two or more support layers 100 and the sleep surface to be made of two or more comfort layers 110 (FIG. 5).

Figure 2:
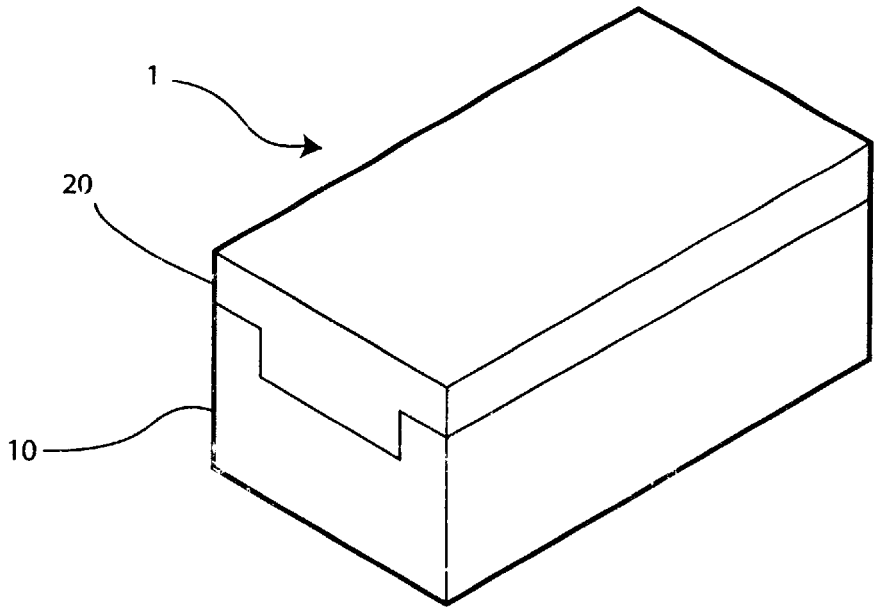
FIG. 2 illustrates a perspective view of the mattress in assembled form in the first embodiment.

The base 10 and sleep surface 20 are designed to be arranged vertically. In the first and second embodiments (FIGS. 1–3) the base and the sleep surface are nested together. Lower portion 24 fits in the channel 14 in the first embodiment or the well in the second embodiment. Upper portion 22 completely covers the edge supports 12. In the preferred embodiment (FIG. 4), the sleep surface does not nest with the base and the edge supports, rather the sleep surface merely overlays them. The result is a mattress delivering superior performance to the consumer.

In use the foam mattress 1 provides support when a user sits on the edge of the bed. The edge supports 12 prevent the mattress 1 from buckling. When the user assumes a prone position on the mattress 1, body weight becomes dispersed and the edge supports 12 are less detectable through the upper portion 22

In the preferred embodiment, the mattress 1 is formed in three parts (the sleep surface 20, the edge supports, and the base 10). The edge supports 12 and the base 10 are of the same thickness. The mattress 1 can also be configured such that the edge supports 12 are not integral to the base 10 and can be made of different materials. The base 10 has an ILD value and a density. The edge support 12 has an ILD value and a density. The sleep surface 20 has an ILD value and a density. The mattress 1 can be customized by changing the physical characteristics of the sleep surface 20, the base 10 and the edge supports 12. This can be done by changing the material that makes up these items. In the preferred embodiment the mattress is composed of a base, an edge support, and a sleep surface. At least two of the ILD values are different and at least two of the densities are different. For the mattress 1 to function as intended the sleep surface 20 and the edge supports 12 have different ILD values and densities. In the preferred embodiment, the sleep surface has a higher density than the edge support density, and the sleep surface has a lower. ILD value than the edge support ILD value.

FIG. 5 shows an alternative configuration of the preferred embodiment. Multiple comfort layers 100 make up the sleep surface 20 and multiple support layers 110 make up base 10. By using different types of materials to make up the comfort layers 100 and support layers 110, the mattress can be adjusted to consumer preferences.

In addition to the configuration of the mattress 1 described above some additional features can be incorporated into the design. Sleep surface 20 can be customized to provide additional lumbar support. This can be done by laminating higher ILD foam in a middle zone to a pair of outer zones (not shown) to create a tri-zone configuration. This is similar to what is described in my '821 patent. The sleep surface then would be composed of different materials. By using firmer foam (a higher relative ILD) in the central portion a prone person receives additional support in the lumbar area. In addition, the central region will maintain the original feel longer than the softer foam as the mattress ages which can extend the effective life of the mattress. The base 10 can also be made in this tri-zone configuration.

A mesh (not shown) made of polyester or wire can be sandwiched between the sleep surface 20 and the base 10 to prevent deflection caused by excessive body weight.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the base and sleep surface could be made of a material other than foam provided the firmness of the component is consistent with the invention and an advantage is found for covering the support edges. The base and the sleep surface could also be made of multiple layers. By selecting layers of foam with higher ILD values moving formt he top towards the base, the mattress exhibits progressive resistance. This allows the mattress to feel similar to people with varying weights. A two hundred and twenty pound person and one hundred and ten pound person would feel similar "firmness" because of the progressive resistance. Thus, the breadth and scope of the present invention should not be limited by any of the above-described exemplary embodiments, but should be defined only in accordance with the following claims appended hereto and their equivalents.

What is claimed is:

1. A composite mattress comprising:

a base made of at least one support layer and having a base ILD and a base density;

an edge support located around a periphery of said base and having an edge support ILD and an edge support density;

a sleep surface made of at least one comfort layer and having a sleep surface ILD and a sleep surface density, the sleep surface sized to cover both said base and said edge support, the sleep surface further comprising a tri-zone configuration having a middle zone and a pair of outer zones, said middle zone being laminated to said pair of outer zones, said middle zone having a middle zone ILD, said outer zones having an outer zone ILD, the middle zone ILD being greater than said outer zone ILD; and wherein at least two of said base ILD, edge support ILD and sleep surface ILD have different values, or at least two of said base density, edge support density and sleep surface density have different values.

2. A composite mattress comprising:

a base made of at least one support layer and having a base ILD and a base density, the support layer of the base further comprising a tri-zone configuration having a middle zone and a pair of outer zones, said middle zone being laminated to said pair of outer zones, said middle zone having a middle zone ILD, said outer zones having an outer zone ILD, said middle zone ILD being greater than said outer zone ILD;

an edge support located around a periphery of said base and having an edge support ILD and an edge support density;

a sleep surface made of at least one comfort layer and having a sleep surface ILD and a sleep surface density, the sleep surface sized to cover both said base and said edge support; and wherein at least two of said base ILD, edge support ILD and sleep surface ILD have different values, or at least two of said base density, edge support density and sleep surface density have different values.

3. A composite mattress comprising:

a base having more than two support layers;

an edge support located on at least two sides of the base;

a sleep surface having at least one comfort layer, the sleep surface adapted to cover the base and the edge support; and wherein the mattress being shaped and adapted such that the edge support prevents buckling of the mattress when a user sits on an edge of the mattress.

4. A composite mattress as set forth in claim 3 further comprising the sleep surface having two comfort layers.

5. A composite mattress as set forth in claim 3 further comprising the sleep surface having more than two comfort layers.

6. A composite mattress comprising:

a base made of at least one support layer;

an edge support located on at least two sides of the base;

a sleep surface having more than two comfort layers, the sleep surface adapted to cover the base and the edge support; and wherein the mattress being shaped and adapted such that the edge support is less detectable to a user in a prone position on the mattress than to the user in a sitting position on the mattress.

7. A composite mattress as set forth in claim 6 further comprising the base having two support layers.

8. A composite mattress as set forth in claim 6 further comprising the base having more than two support layers.

* * * * *